US006451183B1

(12) United States Patent
Treasure et al.

(10) Patent No.: US 6,451,183 B1
(45) Date of Patent: Sep. 17, 2002

(54) METHOD AND APPARATUS FOR ELECTROWINNING POWDER METAL FROM SOLUTION

(75) Inventors: Patrick Anthony Treasure, Oxenford; David Bruce Tarrant, Parkwood, both of (AU)

(73) Assignee: Electrometals Technologies Limited (AU)

( * ) Notice: Subject to any disclaimer, the term of this patent is extended or adjusted under 35 U.S.C. 154(b) by 0 days.

(21) Appl. No.: 09/636,426

(22) Filed: Aug. 10, 2000

Related U.S. Application Data

(60) Provisional application No. 60/148,281, filed on Aug. 11, 1999.

(51) Int. Cl.[7] ..... C25C 7/00
(52) U.S. Cl. ..... 204/272; 204/275.1; 204/269
(58) Field of Search ..... 204/272, 267, 204/269, 275.1

(56) References Cited

U.S. PATENT DOCUMENTS

| | | | | |
|---|---|---|---|---|
| 2,157,699 A | | 5/1939 | Hardy et al. | 204/1 |
| 2,216,167 A | | 10/1940 | Fisher | 204/1 |
| 2,558,750 A | | 7/1951 | Harrison | 75/28 |
| 4,090,927 A | | 5/1978 | Fresnel et al. | 204/10 |
| 5,203,979 A | | 4/1993 | Uffinger et al. | 204/272 |
| 5,873,986 A | * | 2/1999 | Thompson, III et al. | 204/237 |

FOREIGN PATENT DOCUMENTS

| | | | |
|---|---|---|---|
| GB | 2 051 862 A | | 9/1981 |
| WO | WO 92/14865 | | 9/1992 |
| WO | WO 96/38602 | | 12/1996 |
| WO | WO-01/07684 | * | 2/2001 |

* cited by examiner

*Primary Examiner*—Bruce F. Bell
*Assistant Examiner*—Thomas H. Parsons
(74) *Attorney, Agent, or Firm*—Hayes Soloway P.C.

(57) ABSTRACT

A cell for electrowinning a metal in powder form from solution includes a housing having an inlet towards one end thereof and an outlet towards an opposed end. The cell has a cylindrical anode extending substantially axially through the housing and a cathode surrounding the anode spaced outwardly away therefrom. The anode and cathode define a flow passage therebetween having a gap of 5 to 25 millimeters. In use the cell has a substantially vertical orientation with the inlet at the bottom and the outlet at the top. Periodically, flow process solution is interrupted and flush solution is passed in a reverse direction through the cell to remove powder metal from the cathode. A bank of cells in which the individual cells are connected in parallel to respectively an inlet main and an outlet main is also disclosed.

31 Claims, 3 Drawing Sheets

METHOD AND APPARATUS FOR ELECTROWINNING POWDER METAL FROM SOLUTION

CROSS-REFERENCE TO RELATED APPLICATIONS

This application claims the benefit of U.S. Provisional Application No. 60/148,281, filed Aug. 11, 1999.

BACKGROUND OF THE INVENTION

1. Field of the Invention

This invention relates to a method and apparatus for electrowinning metals from a solution containing metals. This invention is particularly concerned with the production of particulate metal, eg in the form of powder, as distinct from plated metal.

This invention relates particularly but not exclusively to a method and apparatus for electrowinning copper in a powder form from a copper bearing solution, eg a low grade copper solution such as is often found at mines and mineral processing sites, and it will be convenient to hereinafter describe the invention with reference to this example application. However, it is to be clearly understood that the invention also applies to other metals, eg silver, nickel, cobalt and tin.

2. Description of the Related Art

The applicant has previously designed an electrowinning cell for electrowinning metals such as copper and tin from aqueous solutions. The cell is disclosed in the applicant's international patent application number (WO 96/38602) entitled mineral recovery apparatus. The entire contents of this specification are explicitly incorporated into this document by cross-reference.

The above application discloses a cell having a tangential inlet at the bottom of the housing and a tangential outlet at the top of the housing. The orientation of the inlet which directs solution into the cell with a particular orientation in conjunction with the cylindrical housing induces a helical spiral flow through the cell. A rod-like anode extends axially the length of the housing coaxial with the cell and a split sleeve cylindrical cathode bears against the wall of the housing and circumferentially surrounds the anode spaced outwardly therefrom. In use, a potential difference is applied across the flow passage between the cathode and the anode to drive the electrowinning metal production process. The helical flow through the cell from the inlet to the outlet presents copper ions to the cathode continuously to plate out the copper economically even in low grade solutions.

This process progessively plates out a copper tube on the inside of the split sleeve. When the copper plate is about 6 to 8 cm thick (2.4 to 3.14 inches) it is harvested. This is accomplished by removing a top end cap from the cell and lifting the split sleeve out through the top of the cell. This is a labor intensive process and interferes with the otherwise continuous nature of the process.

As a commercial plant using the process contains banks of literally hundreds of cells, the harvesting of the cells in the manner described above is a labor-intensive process. A further disadvantage of the production of copper tubes in the manner described above is that the tubes require specific handling and transport procedures. It would therefore be advantageous if an easier method for harvesting the copper from the electrowinning cells could be devised.

In addition, the electrowinning cell described above may have less than optimum efficiency because of the large gap or distance between the cathode and anode. As a result, a relatively high voltage has to be applied across the cathode and anode and the applicable current density is relatively lower. As the amount of metal produced is directly proportional to the current density across the cathode and anode, it is desirable to have as high a current density per unit amount of electrical power input as possible.

SUMMARY OF INVENTION

According to a first aspect of this invention there is provided a cell for electrowinning a metal in powder form from solution, the cell including:

a housing having an inlet towards one end thereof and an outlet towards an opposed end;

an anode extending substantially axially through the housing;

a cathode surrounding the anode spaced outwardly away from the anode to define a flow passage between the cathode and anode, having a gap of 5 to 25 millimeters (0.20–0.98 inch); and means for applying a potential difference between the anode and the cathode.

The cell therefore has a substantially narrower gap between the cathode and anode than either electrowinning plate cells or cylindrical cells for producing copper tubes. This assists in increasing the current density between the cathode and the anode, particularly for low conductivity solutions.

More preferably the gap is 5 to 20 millimeters (0.20 to 0.80 inches), even more preferably 10 to 15 millimeters (0.40 to 0.60 inches), most preferably 12 to 13 millimeters (0.47 to 0.51 inches).

Typically, both the anode and the cathode are substantially cylindrical. The cathode may be formed by the wall of the housing or by a sleeve positioned adjacent the wall of the housing. Preferably the cathode is formed by the wall of the housing which is metallic.

Typically one end of the cell has a relatively upper orientation and an opposed end of the cell has a relatively lower orientation in use, and the inlet is positioned at or adjacent the lower end and the outlet is positioned at or adjacent the upper end.

Thus, in use, process solution containing metal ions to be electrowon travels upwardly through the cell from the inlet to the outlet and metal is deposited on the cathode as a powder. Periodically, a flush solution is pumped in a reverse direction through the cell to remove deposited powder metal from the cell for harvesting. It is preferred that the process solution travels up through the cells so that gas generated by the electrowinning process can be vented through a vent associated with an upper region of the cell. It is particularly preferred that flush solution travels downwardly through the cell so that gravity assists with the flushing process. Typically, flushing would be assisted by other factors such as increased pressure of flush solution and passing air bubbles or other means over the cathode to assist in loosening the metal powder.

Preferably, the inlet directs solution into the cell in substantially an axial direction.

Preferably, the outlet is oriented such that flushing fluid which is passed through the cell in a reverse direction is directed axially into the cell through the outlet.

In a preferred form said inlet is defined in said one end of the cell and said outlet is defined in said opposed end of the cell.

The orientation of the inlet and gap of the flow passage facilitates process solution flowing through the flow passage with a turbulent flow. This is quite different from the tangential inlet in the prior art cell which induces a helically spiralling plug flow through the cell from inlet to outlet. Plug flow is fundamentally different from turbulent flow. Turbulent flow assists with the formation of powder metal as distinct from plate metal.

It is similarly advantageous that the flush solution which flows in a reverse direction through the outlet of the cell is directed axially into the cell to promote turbulent flow. This turbulent flow of flush solution assists in dislodging the metal powder from the cathode.

Preferably, the cell further includes means for guiding powder which is washed off the cathode during a flush cycle towards the inlet through which it is drained from the cell, eg a sloping internal surface of the housing.

This reduces the likelihood of metal powder collecting in dead spaces in the bottom of the cell and assists in fully draining metal powder from the cell.

Preferably, the cell further includes cleaning means for clearing metal plate obstructions from the flow passage between the anode and cathode of particulate metal and the cleaning means comprises a mechanical cleaner which is physically moved along the flow passage.

Naturally the process flow parameters are set so as to reduce the likelihood of solid metal, eg dendrites of metal, from depositing on the cathode. Applicant therefore believes that it is highly unlikely that metal plate obstructions such as dendrites will form in the flow passage. However, it is still necessary to provide a means for checking for and removing blockages of metal should they occur to provide a reliable piece of process equipment for use in a commercial plant.

Preferably, the ends of the anode are closed to direct fluid around the anode and through the annular flow passage. One end has a flow formation having a broadly conical configuration for directing flush solution passing through the outlet towards the flow passage. The closed ends ensure that solution flows around the anode and through the flow passage.

The cell may also include a support for supporting the anode in the form of a support member mounted to an end of the housing and projecting substantially axially into the housing. The support member mechanically supports the anode in the appropriate position vertically aligned with the cathode and also electrically connects the anode to the electrical circuit.

In a particularly preferred form the housing comprises a cylindrical body of stainless steel and end caps of non-conductive material on each end of the cylindrical body, each of the end caps defining a chamber positioned axially outwardly of the cathode and anode. One of the end chambers may form the sloping internal surface described above for guiding powder metal through the inlet.

This way the cylindrical body which forms the cathode is electrically isolated from the support member and electrical connection to the anode which passes through one of the end caps.

A particularly preferred form of the cell has a cathode with a diameter of 7½ to 8½ inches (190 to 216 mm), preferably about 8 inches (203 mm), and an anode with a diameter of 6½ to 7½ inches (165 to 190 mm), preferably about 7 inches (178 mm), with the gap between the anode and cathode being 0.5 to 1.5 inches, preferably about 1 inch (25.4 mm). Further, in the most preferred form, the housing is substantially vertically extending and the inlet is defined in the end of the lower end cap and the outlet is defined in the end of the upper end cap.

The cell may also include means for bubbling gas up through the flow passage. The bubbling means may comprise an apertured pipe positioned in the bottom of the chamber through which eg air is passed.

According to another aspect of this invention there is provided a bank of cells including:

a plurality of cells as defined above with respect to the first aspect of the invention, arranged in parallel;

an inlet main coupled directly to the inlet of each of the cells in the bank for directing process solution through the cells in parallel;

an outlet main coupled directly to the outlets of each of the cells for directing process solution away from the cells; and means for interrupting a flow of process solution through the bank of cells when required and then passing a flush solution in a reverse direction through the outlet main, then through each of the cells in the bank, and then out through the inlet main.

In use, therefore, process solution is passed in parallel through each of the cells of the bank and flush solution in turn is periodically or intermittently passed in a reverse direction in parallel through the cells to flush the powder metal out of the cells.

Preferably, the flow reversal means includes a process solution inlet valve means for opening and shutting off the flow of process solution into the inlet main, and process solution outlet valve means for opening and shutting off the flow of process solution out of the outlet main in a downstream direction and also flush solution inlet valve means for opening and shutting off the flow of process solution into the outlet main, and flush solution outlet valve means for opening and shutting off the flow of flush solution out of the inlet main.

Thus, control of respectively process and flush solution flow through the bank of cells can be accomplished by an inlet and outlet main and single sets of valves associated with each of the process and flush solutions. This is a fairly simple reticulation and valve arrangement for a bank having a number of cells. It is far simpler than having a separate valve arrangement for each cell.

The bank may further include control means for controlling the valves eg to permit only flush solution or process solution to flow through the bank at one time. Many different control means may be used but a PLC controller is particularly useful.

The control of the valve means can be accomplished in a variety of ways including by manual control. The PLC controller is a proven piece of off-the-shelf equipment that can be used to reliably control the process.

Typically, the bank will also include means for venting gas generated by the electrowinning process from the cells in the bank. Typically, the venting means comprises a vent operatively coupled to the outlet main.

The vent is important for removing gas generated by the electrowinning process in a commercial plant. By having the outlet main operatively coupled to the outlets of each of the cells a single vent can be used to vent all the cells in a bank. It is considerably simpler and cheaper than having a vent for each cell.

Preferably, the inlet main is adjacent a lower end of each of the cells and the outlet main is adjacent an upper end of the cells. Naturally, the inlet and outlet main will be positioned so as to minimise the length of piping required.

According to yet another aspect of this invention, there is provided a method of operating an electrowinning cell for electrowinning a metal from solution, the cell having a spaced inlet and outlet and a substantially cylindrical cathode surrounding an anode defining a flow passage therebetween, the method including:

passing a metal containing process solution through the flow passage from the inlet to the outlet while a voltage is applied across the cathode and anode so as to deposit particulate metal from the solution on the cathode;

periodically interrupting the flow of solution through the cell and passing a flush solution in a reverse direction through the cell, the flush solution dislodging metal powder from the cathode and washing it out of the cell and into a metals recovery section of the plant.

The method may include the further step of recovering the particulate metal from the flush solution, eg in a metal recovery section of the plant.

Advantageously, the method further includes the step of interrupting the flow of flush solution when the particulate or powder metal has been removed from the cells and restoring the normal flow of solution through the cell to plate out further copper.

The method may include flushing the cells after 1 to 6 hours of pumping process solution through the cells, typically 2½ to 4½ hours of passing process solution through the cells. Typically, the flush solution is passed through the cell for 15 to 30 seconds, preferably 20 to 25 seconds.

Preferably, the process solution is passed through the cell at flow rate of 1,000 to 3,500 liters per hour (624–925 gallons per hour), preferably 2,000 to 3,000 liters per hour (5.28–792 gallons per hour), and the flush solution is pumped through the cell at a flow rate of 6,000 to 10,000 liters per hour (1585–2642 gallons per hour), preferably 7,000 to 9,000 liters per hour (1849–2378 gallons per hour).

Typically, the flush solution is pumped through the cell at a higher pressure than the process solution. This higher pressure assists in dislodging metal powder from the cathode.

In a typical cell during normal operation the metal containing process solution travels up the cell from the inlet to the outlet and the flush solution travels in a reverse direction down the cell from outlet to inlet. This way gravity assists in dislodging the powder metal from the cathode and in washing it out of the cell.

The method may also include periodically passing a mechanical cleaner through the flow passage to remove any plate or other solid dendrites or the like which may have plated out on the cathode.

The method may also include passing bubbles, eg air bubbles, up through the flow passage of the cell, eg after the flow of process solution has been interrupted and before the flow of flush solution has been started, to assist in dislodging powder metal from the cathode.

According to yet another aspect of this invention, there is provided an electrowinning plant comprising a plurality of banks of cells as described above with reference to the second aspect of the invention, the banks being operatively connected together such that process solution containing metal to be electrowon can be passed through each of the banks in series.

Typically, flush solution is passed in a reverse direction through the banks of cells.

Typically, the flush solution is only passed through a single bank of cells at any one time. It is not passed through all the banks in series in a reverse direction.

The plant may comprise at least three banks of cells in series. The exact number of banks for any particular application will depend on the initial grade of process solution and the target grade of the product solution as well as the current density in the cells.

Typically, only one bank of cells has the flow of process solution therethrough interrupted for flushing at any one time. That way the flow of process solution through the plant can be continuous, only one bank of cells being taken out of production for flushing at any one time.

BRIEF DESCRIPTION OF THE DRAWINGS

An apparatus and a method in accordance with this invention may manifest itself in a variety of forms. It will be convenient to hereinafter describe in detail several preferred embodiments of the invention with reference the accompanying drawings. The purpose of providing these drawings is to instruct persons having an interest in the subject matter of the invention how to carry the invention into practical effect. It is to be clearly understood however that the specific nature of this description does not supersede the generality of the preceding broad description. In the drawings:

In FIGS. 1 and 2 reference numeral 1 refers generally to a cell in accordance with the invention.

DETAILED DESCRIPTION OF THE INVENTION

Figure 1:
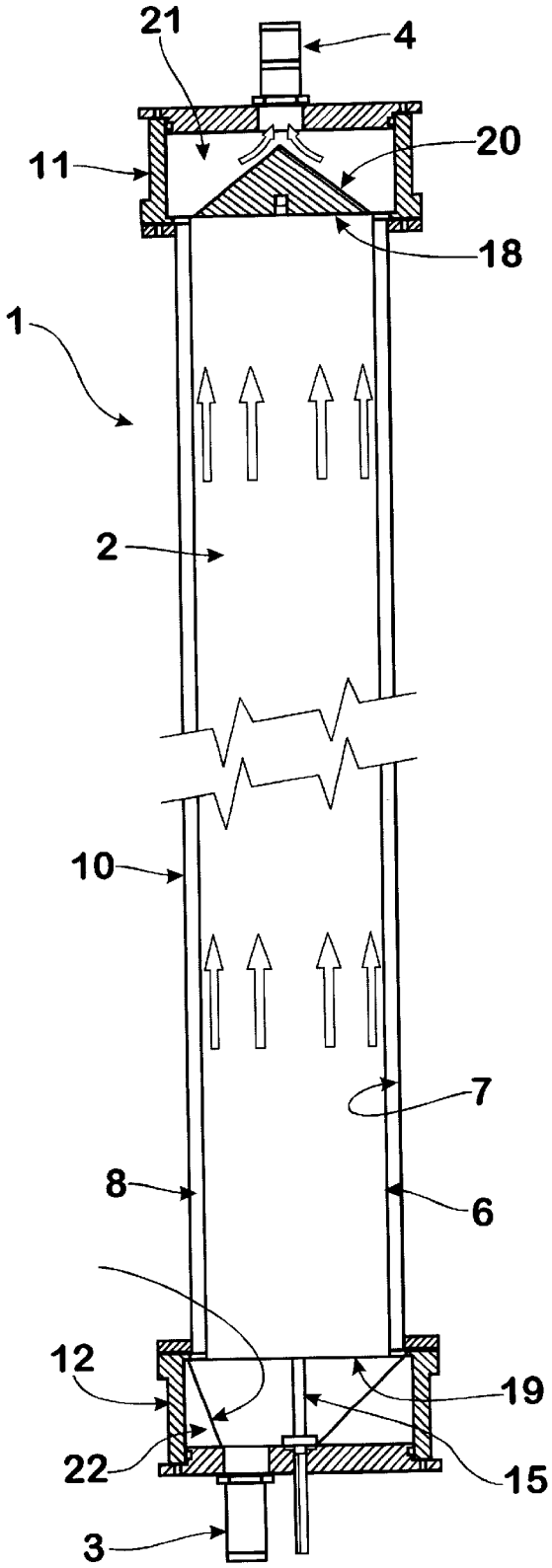
FIG. 1 is a sectional front view of a cell in accordance with the invention in a normal process flow condition.

The cell 1 comprises broadly a housing 2 having an inlet 3 at the lower end thereof and an outlet 4 at the upper end thereof. The cell 1 further includes an axially extending anode 6 and a cathode 7 spaced radially away from the anode 6. The anode 6 and cathode 7 define a flow passage 8 therebetween through which process solution is passed from the inlet 3 to the outlet 4. The cell also includes electrical power and an electrical circuit for applying a potential difference across the cell between the anode 6 and the cathode 7. In use, the cell alternates between a process flow condition illustrated in FIG. 1 and a flush flow condition illustrated in FIG. 2.

The housing 2 comprises broadly an elongate circular cylindrical body 10, eg made of stainless steel, and end caps 11 and 12, eg made of engineering plastics material, mounted on each end of the cylindrical body 10. Typically, the end caps 11 and 12 are permanently mounted to the body 10, although this is not necessary. In the illustrated embodiment, the ends of the body are flanged and the end caps are mounted to the body by bolts passing through the flanges and the end caps.

In preferred forms, the body 10 has a diameter of 6 inches (152.4 millimeters) or 8 inches (203.2 millimeters). The inlet 3 which is axially extending is defined in the bottom end cap 12 of the housing 2 which directs process solution axially in the housing 2. In the illustrated embodiment, the inlet 3 is positioned off centre although the precise position of the inlet is not essential. The inlet is positioned off centre to accommodate a centrally positioned support member which is described in more detail below.

The inlet 3 and outlet 4 will typically have a diameter of 35 to 40 millimeters. This is to facilitate a flow rate of about 1000 to 3500 liters per hour through the cells during the normal process flow conditions and 6000 to 10,000 liters per hour during the flush flow condition.

The outlet 4 extends axially away from the upper end cap 11 of the housing in a similar fashion to the inlet 3. The outlet 4 is however centrally positioned as illustrated. When powder metal is flushed from the cell the outlet 4 acts as an inlet for the flush solution and the inlet 3 acts as an outlet for the flush solution as will be described in more detail below.

The cathode 7 is formed by the wall of the body 10 which is made of electrically conductive material as described above.

The anode 6 is similarly cylindrical being sized to leave a relatively small gap and flow passage 8 between the anode 6 and the cathode 7. Typically, the width of the flow passage is of the order of 10 to 15 millimeters (0.40 to 0.60 inches). Consequently, the difference in diameter between cathode and anode is typically about 1 inch (25.4 millimeters). In the illustrated embodiment, the anode 6 has a diameter of 7 inches and the cathode 7 has a diameter of 8 inches.

The anode 6 is supported by a support 15 projecting through the lower end cap 12 of the housing 2. The member 15 is substantially centrally positioned which is why the inlet 3 is off centre. The member 15 is positively attached to both the end cap 12 and the anode 6 to support the anode in the appropriate vertical position aligned with the cathode.

Naturally, the upper and lower ends 18 and 19 of the anode 6 are closed so as to direct solution around the anode 7 into the flow passage 8. The upper end of the anode 6 comprises a conical flow formation 20 for directing flush solution entering the housing 2 around the anode 6 and through the flow passage 8.

The end caps 11 and 12 space the inlet 3 and outlet 4 axially away from the ends of the cathode 7 and anode 6. This defines chambers 21 and 22 adjacent the inlet 3 and outlet 4. In the illustrated embodiment, the chamber 22 has a flow surface 23 which slopes inwardly from the sides of the end cap 12 towards the inlet 3. This assists in guiding or directing powder metal towards the inlet 3 when it is flushed off the cathode 7.

Figure 2:
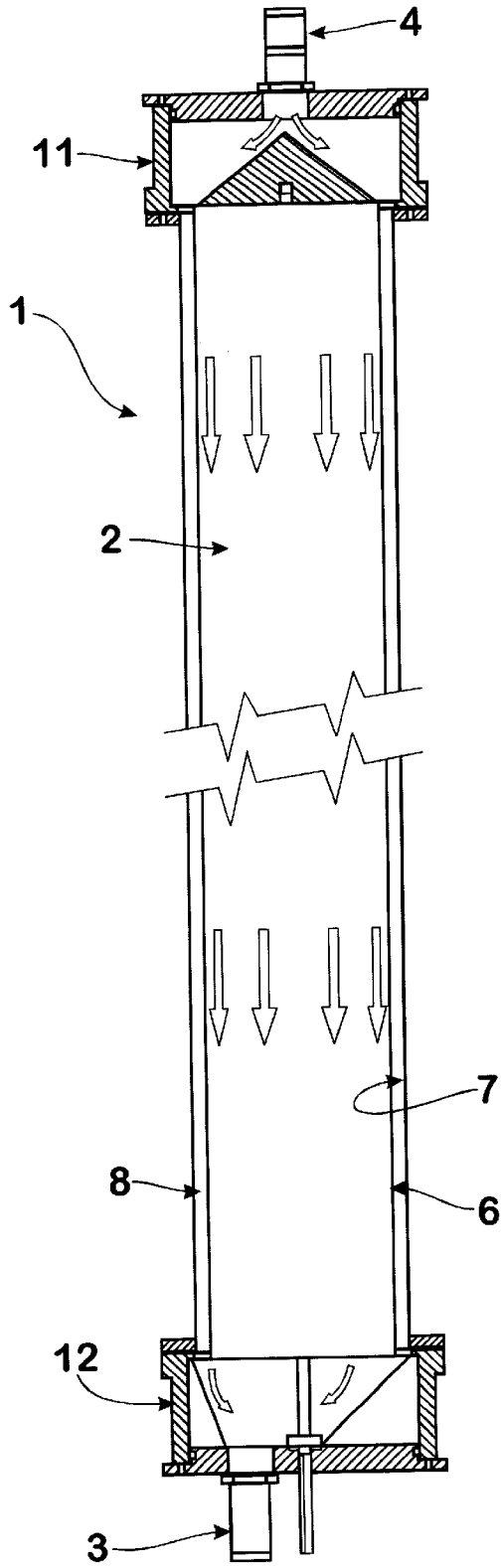
FIG. 2 is a sectional front view of the cell of FIG. 1 in a flush flow condition.

In the process flow condition, process solution containing metal ions for electrowinning, eg Cu ions, is passed upwardly through the cell from the inlet 3 to the outlet 4 as shown in FIG. 1. While the process solution is being passed through the flow passage 8, a voltage is applied across the flow passage from the cathode 7 to the anode 6. This causes deposited metal, eg in the form of metal particles or metal powder, to deposit on the cathode 7. After some time when the solid copper has at least partially occluded the flow passage 8, the flow of process solution through the cell 1 is interrupted.

The cell induces powder metal to deposit on the cathode. The formation of powder as distinct from plate metal is promoted by: turbulent flow in the flow passage, reducing the flow rate of process solution and thereby the velocity of the solution over the cathode when compared with applicant's prior art cell, reducing the current density and treating a relatively low grade solution. Certain process parameters will yield the formation of powder metal depending on the grade of process solution.

The lower the grade of metal in solution the more likely the metal is to produce powder. Further, the lower the velocity of fluid through the cell and the current density the more likely the solution is to produce powder metal as distinct from plate metal. Further, turbulent flow through the cell as distinct from plug flow also promotes the formation of powder.

Thereafter, a flow of flush solution is commissioned in a reverse or downward direction from the outlet 4 to the inlet 3. The flush solution, assisted by gravity, dislodges the powder metal deposited on the cathode 7 and displaces it down the cathode 7 towards the inlet 3. The inlet 3 acts as an outlet in the flush flow condition.

The tapered walls of the chamber defined by the end cap 12 assists in guiding the powder metal towards and through the outlet 3. The pressure of the flush solution is typically higher than the process solution to assist the flushing process.

From the inlet 3, the powder metal is typically conveyed, eg by means of the flush solution in a gravity drain, to a downstream collection or further processing point.

The flush flow condition is usually carried out for 20 to 25 seconds, although this specific time is not critical. After the metal has been flushed from the cell, the flow of flush solution is interrupted and the flow of process solution is restored.

Figure 3:
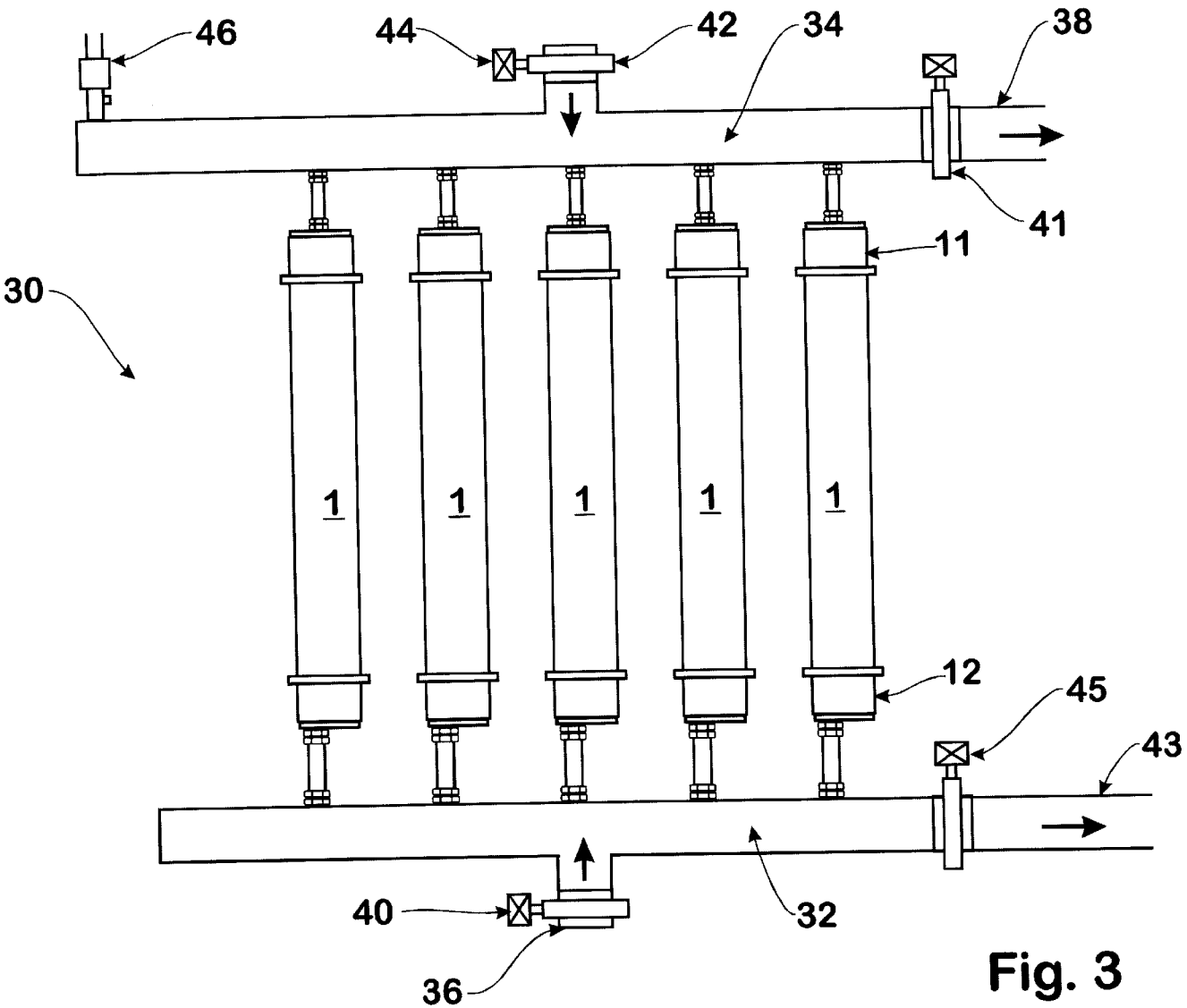
FIG. 3 is a front view of a bank of the cells of FIG. 1 operatively coupled to each other.

In FIG. 3, reference numeral 30 refers generally to a bank of cells. Each of the cells is as described above with reference to FIGS. 1 and 2. Accordingly, the same reference numerals will be used to refer to the components of the cells as in FIGS. 1 and 2.

Each bank of cells 30 comprises a plurality of cells 1, typically 5 to 20, connected in parallel. An inlet main 32 is operatively coupled to the inlets 3 of each of the cells 1 and an outlet main 34 is operatively coupled to the outlets 4 of each of the cells 1.

A process solution inlet conduit 36 is operatively coupled to the inlet main 32. Similarly, a process solution outlet conduit 38 is also operatively coupled to the outlet main 34. Process solution inlet and outlet valves 40 and 41 are provided for opening and shutting off the flow of process solution through the mains 32 and 34.

Correspondingly, the outlet main 34 is coupled to a flush solution inlet conduit 42 and the inlet main 32 is coupled to a flush solution outlet conduit 43. This typically is a gravity drain leading to a settling cone. These conduits also have associated therewith valves 44 and 45 similar to valves 40 and 41.

The bank 30 also includes gas vent means in the form of a riser 46 including a pneumatic valve projecting out from an upper region of the outlet manifold 34. This enables the gases generated by the electrowinning process to be vented from the process as is necessary. Further, it enables this to be efficiently accomplished by having a single vent for the entire bank 30 of cells.

Typically, the valves 40, 41, 44 and 45 are pneumatic valves although other valves may also be used.

The bank 30 also includes control means in the form of a PLC controller for opening and closing the valves to change the bank between process flow condition and flush flow condition. Each process flow cycle lasts one to three hours, eg two hours and each flush flow cycle lasts 20 to 25 seconds.

In use, process solution is passed through the conduit 36 through the valve 40 into the inlet main 32. It then flows through each of the cells 1 in parallel. During the passage through the cells metal is electrowon from solution as is described above with reference to FIGS. 1 and 2. The solution then exits the cells 1 through the outlets 4 and passes into the outlet main 34 and from there out from the conduit 38. From there it passes to the next bank of cells.

When the bank is changed from process flow condition to flush flow condition, valves 40 and 41 are closed and valves 44 and 45 are opened. This shuts off process solution and permits flush solution to flow through the cells in a reverse direction.

An advantage of the bank of cells described above is that it has a relatively simple valve system. The entire bank of cells has only four valves for reversing flow through the individual cells. This makes the process more reliable and maintenance free. It is also cheaper. In addition, a single gas vent is used for the entire bank of cells.

Figure 4:
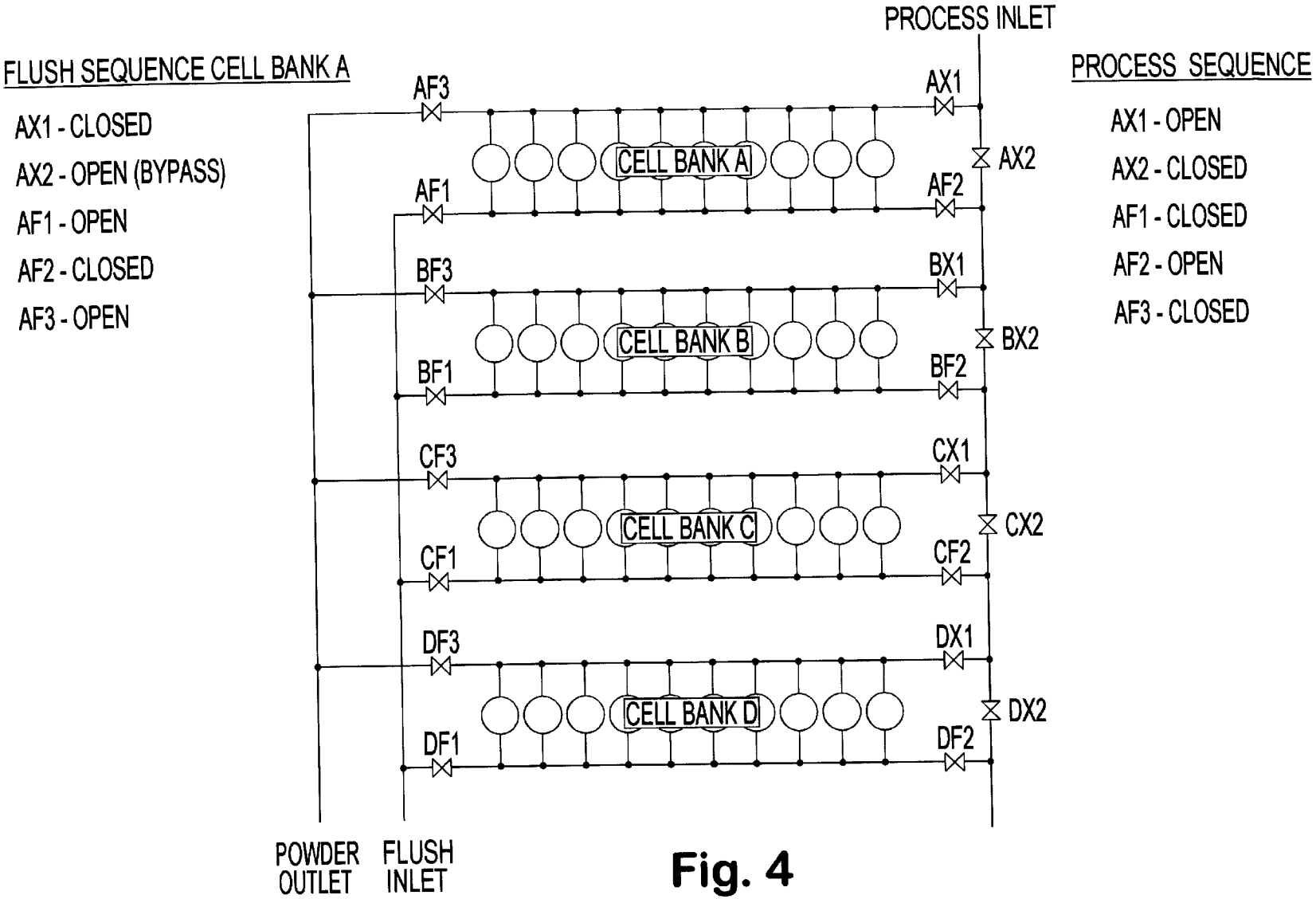
FIG. 4 is a process flow sheet of a plurality of banks of cells of FIG. 3.

FIG. 4 illustrates a flow sheet of a plant comprising a plurality of banks of cells. Each bank is as described above with reference to FIG. 3. Accordingly the same reference numerals will be used to refer to the same components as in FIGS. 1 to 3.

The individual cells in each bank 30 are connected in parallel, the inlets 3 and outlets 4 of each 1 being directly connected to respectively the inlet main 32 and outlet 34 main. The banks of cells in turn are connected in series. Thus, a process solution containing metal ions is passed through each of the banks in turn. Metal ions are progressively stripped from the solution as it passes through each of the banks of cells. Thus, the total number of banks of cells used in any plant will depend on the initial grade of the feed solution, the amount of metal desired to be removed, and the target grade of the end product solution.

Only one bank of cells is flushed at a time. This enables a continuous flow of process solution through the plant with the solution merely bypassing the bank of cells which is being flushed. The bank is flushed by passing flush solution in a reverse direction through the cells in parallel. The flush solution and entrained metal powder is collected in the inlet main and then directed by gravity to a settling tank.

A key advantage of the cell described above is that it produces metal powder which is easy to handle as distinct from copper tubes. It also permits the metal powder to be automatically harvested by means of a process arrangement rather than manual handling. With prior art cells, it is necessary to periodically open up the cell and physically remove a bulky tube of copper and then close up the cell to recommence the process. The process described above is the only non-invasive automatic electrowinning cell of which the applicant is aware. As a result of these properties, it is practical and applicable to industrial scale plants.

An advantage of the cell described above is that it is able to produce powder metal relatively efficiently. Because the cathode anode gap is relatively narrow the current density is higher for a given voltage which leads to a higher yield of metal product.

Another advantage of the plant described above is that a single inlet main and outlet main and a single set of valves can be used to control the flushing of the cells to harvest powder metal.

It will of course be realized that the above has been given only by way of example, and that all such modifications and variations thereto as would be apparent to persons skilled in the art are deemed to fall within the broad scope and ambit of the invention as is herein set forth.

What is claimed is:

1. A cell for electrowinning a metal in powder form from solution, the cell including:

a housing having an inlet towards one end thereof for introduction of solution to be electrowon, and an outlet towards an opposed end;

an anode extending substantially axially through the housing;

a cathode surrounding the anode spaced outwardly away from the anode to define a flow passage between the cathode and anode having a gap of 5 to 25 millimeters; and means for applying a potential difference between the anode and the cathode.

2. A cell according to claim 1, wherein said outlet is adapted for passing a hydraulic flush solution axially into the cell in a reverse direction through the flow passage between the anode and cathode to detach metal plated on the cathode from the cathode and flush detached metal out of the housing through the inlet.

3. A cell according to claim 2, wherein said outlet is oriented such that said hydraulic flush fluid is directed axially into the cell to promote turbulent flow.

4. A cell according to claim 1, wherein the housing is metallic, and a wall of the housing forms the cathode.

5. A cell according to claim 1, wherein ends of the anode are closed to direct solution around the anode and then through the flow passage.

6. A cell according to claim 1, wherein one end of the cell has a relatively upper orientation and an opposed end of the cell has a relatively lower orientation in use, and the inlet is positioned at or adjacent the lower end and the outlet is positioned at or adjacent the upper end so that metal containing solution flows upwardly through the cell and flush solution flows downwardly through the cell.

7. A cell according to claim 1, wherein said inlet and said gap are oriented so as to promote turbulent flow of solution.

8. A cell according to claim 1, wherein the cathode is substantially cylindrical and the anode is also cylindrical but with a diameter less than that of the cathode.

9. A cell according to claim 1, wherein the gap between the anode and the cathode is 10 to 15 millimeters.

10. A cell according to claim 1, further including a flow formation having broadly a conical configuration for directing flush solution entering the cell through the outlet towards the flow passage between the cathode and the anode.

11. A cell according to claim 1, wherein the cell further includes means for guiding powder which is washed off the cathode during a flush cycle towards the inlet.

12. A cell according to claim 11, wherein the guiding means is formed by the internal surface of the housing which slopes inwardly downwardly towards the inlet.

13. A cell according to claim 1, further including mechanical cleaning means physically movable along the flow passage for breaking any dendrites of metal that may form in the flow passage between the anode and cathode.

14. A cell according to claim 1, further including a mechanical support for supporting the anode in the housing.

15. A cell according to claim 14, wherein the support includes a support member mounted to an end of the housing and projecting substantially axially into the housing where it supports the anode, and wherein the inlet is off-set from a central position to accommodate the support.

16. A cell according to claim 1, wherein the housing comprises a cylindrical body of stainless steel and end caps of non-conductive material and each of the end caps defines a chamber axially outwardly of the cathode and the anode.

17. A cell according to claim 16, wherein the cathode has a diameter of 7½ inches (190.5 mm) to 8½ inches (215.9 mm) and the anode has a diameter of 6½ inches (165.1 mm)

to 7½ inches (190.5 mm), and the difference in diameter between the anode and the cathode is 0.5 inches (12.7 mm) to 1.5 inches (38.1 mm).

18. A cell according to claim 1, further including means for bubbling gas upwardly through the flow passage between the cathode and the anode for assisting in dislodging metal powder from the cathode.

19. A cell according to claim 1, wherein the housing is substantially vertically extending and wherein the inlet is defined in the bottom end of the cell and the outlet is defined in the top end of the cell, and the cathode and anode define a gap of 10 to 15 millimeters therebetween.

20. A bank of cells including:

a plurality of cells as defined in claim 1 arranged in parallel;

an inlet main coupled directly to the inlet of each of the cells in the bank for directing process solution through the cells in parallel;

an outlet main coupled directly to the outlets of each of the cells for directing process solution away from the cells; and means for interrupting a flow of process solution through the bank of cells when required and then passing a flush solution in a reverse direction through the outlet main, then through each of the cells in the bank, and then out through the inlet main.

21. A bank of cells according to claim 20, wherein said flow reversal means includes a process solution inlet valve means for opening and shutting off the flow of process solution into the inlet main, and process solution outlet valve means for opening and shutting off the flow of process solution out of the outlet main in a downstream direction.

22. A bank of cells according to claim 21, wherein the flow reversal means further includes flush solution inlet valve means for opening and shutting off the flow of process solution into the outlet main, and flush solution outlet valve means for opening and shutting off the flow of flush solution out of the inlet main.

23. A bank of cells according to claim 22, further including control means for controlling respectively opening and shutting of the process solution inlet valve means and outlet valve means and the flush solution inlet valve means and outlet valve means.

24. A bank of cells according to claim 23, wherein the control means only permits the flush solution inlet and outlet valve means to open when the process solution inlet and outlet valve means are closed.

25. A bank of cells according to claim 24, wherein the control means only permits the process solution inlet and outlet valve means to open when the flush solution inlet and outlet valve means are closed.

26. A bank of cells according to claim 23, wherein the control means is a PLC controller.

27. A bank of cells according to claim 20, further including means for venting gas from each of the cells in the bank.

28. A bank of cells according to claim 27, wherein the gas venting means comprises a vent operatively coupled to the outlet main.

29. A bank of cells according to claim 20, wherein the inlet main is adjacent to or proximate to a lower end of each of the cells.

30. A bank of cells according to claim 29, wherein the outlet main is adjacent to or proximate to an upper end of the cells.

31. A bank of cells according to claim 30, wherein the inlet main is spaced a short distance substantially directly below the lower ends of the cells and the outlet main is spaced a short distance directly above the upper ends of each of the cells.

* * * * *

UNITED STATES PATENT AND TRADEMARK OFFICE

CERTIFICATE OF CORRECTION

PATENT NO. : 6,451,183 B1 
DATED : September 17, 2002
INVENTOR(S) : Treasure et al.

It is certified that error appears in the above-identified patent and that said Letters Patent is hereby corrected as shown below:

Title page,
Item [57], ABSTRACT,
Line 9, after "outlet at the top." and before "Periodically" insert
-- During the flow of process solution through the cell metal powder is deposited on the cathode. --

Signed and Sealed this

Sixteenth Day of November, 2004

JON W. DUDAS
*Director of the United States Patent and Trademark Office*